United States Patent [19]

Troncoso, Jr.

[11] Patent Number: 4,686,956

[45] Date of Patent: Aug. 18, 1987

[54] REST DEVICE

[76] Inventor: Fernando Troncoso, Jr., 14090 6100 Rd., Montrose, Colo. 81401

[21] Appl. No.: 848,628

[22] Filed: Apr. 7, 1986

[51] Int. Cl.[4] ..... F41D 10/00

[52] U.S. Cl. ..... 124/41 A

[58] Field of Search ..... 124/24 R, 41 A

[56] References Cited

U.S. PATENT DOCUMENTS

| | | | |
|---|---|---|---|
| 3,828,757 | 8/1974 | Finlay | 124/41 A |
| 3,935,854 | 2/1976 | Troncoso | 124/41 A |
| 4,236,497 | 12/1980 | Troncoso | 124/41 A |
| 4,332,232 | 6/1982 | Troncoso | 124/41 A |
| 4,476,846 | 10/1984 | Carville | 124/41 A |

*Primary Examiner*—Richard C. Pinkham
*Assistant Examiner*—Benjamin Layno
*Attorney, Agent, or Firm*—Donald E. Nist

[57] ABSTRACT

The archery arrow rest device includes an arrow launcher in the form of an upwardly and forwardly extending blade having a forked upper end for contacting the underside of an arrow shaft, flanked by a pair of flexible, resilient, bendable, upwardly and forwardly extending wire arms for gripping the opposite sides of the arrow shaft. Those arms are connected to the launcher or to a transverse support arm, as is the launcher. The launcher may be pivotally connected to such transverse arm, and biased to a position perpendicular to the transverse arm by springs connected to it or to the arrow-gripping arms so as to eliminate the need for a plunger. The transverse arm is laterally adjustably received in a block securable to the side of an archery bow riser to adjustably support the launcher at a desired location in the bow window. The launcher may be of resiliently depressible material and/or may be rotatable into a depressed position but spring biased to the upright position along with the transverse arm. Such transverse arm may be square in cross-section, toothed as its four exterior edges and driven by a wheel in the block. A click stop mechanism may be attached thereto.

9 Claims, 11 Drawing Figures

REST DEVICE

BACKGROUND OF THE INVENTION

1. Field of the Invention

The present invention generally relates to sports devices and more particularly to an improved type of archery bow arrow rest.

2. Prior Art

Conventional archery bow arrow rests support the arrow shaft in the archery bow window before launching of the arrow. Most such supports are merely shelves attached to the sidewall of the bow and projecting horizontally into the bow window through which the arrow passes during shooting. It has been found that most rests interfere to some degree with arrow flight, deflecting the arrow from its intended path because the arrow feathers or vanes strike the rest during shooting. This also causes wear of feathers and vanes, inducing erratic arrow flight and requiring frequent vane and feather replacement.

Collapsible rests have been devised to solve this problem, but are expensive and not entirely efficient and reliable. Moreover, most rests do not sufficiently support the arrow shaft to prevent its inadvertent movement thereon during drawing of the bowstring by the fingers, or with a tab and even with some types of mechanical releases, thus shifting the target hit point. They also do not prevent the arrow from rolling off the rest if the arrow is carried on the rest before the bowstring is drawn. This is sometimes done in hunting, where a hit may depend on the hunter's ability to shoot an arrow in a split second of opportunity.

A further difficulty with most rests is that they do not obviate the need for a separate side-pressure plate or cushion plunger projecting into the window from the bow sidewall so as to bear against the side of the arrow shaft and absorb some of the arrow shaft side bending forces (archer's paradox) encountered during arrow shooting with fingers. Such pressure plate or plunger, although expensive, is also useful when mechanical releases are employed because shaft side bending still occurs to some degree. However, the plunger must be adjusted to work well and it forms a separate mechanical obstruction against which the arrow vanes or feathers can readily strike to deflect the arrow from the desired target point during shooting.

Accordingly, there is a need for an improved type of arrow rest which will prevent arrow shifting and roll-off while the arrow is stored or carried thereon, thereby making it ready for instant use, as is desirable and sometimes required in many hunting circumstances. Such rest preferably should also eliminate the need for a side pressure plate or cushion plunger, yet provide improved unimpeded, smooth arrow flight and greater speed and shooting accuracy, without feather or vane wear. Such rest should also be resiliently depressible to absorb the downward pressures exerted on the arrow at bowstring release during shooting. Moreover, the rest should be readily adjustable in position in the bow window in order to accommodate to various bows and arrows.

SUMMARY OF THE INVENTION

The improved rest device of the present invention staisfies all the foregoing needs. The device is substantially as set forth in the Abstract. Thus it features a slim upwardly and forwardly extending fork-tipped, resilient launcher supported for vertical dispersion on a laterally adjustable cross-arm received in a block which is attachable to the bow sidewall so as to hold the launcher in the bow window.

The launcher is flanked by a pair of mantis-like resilient, flexible, bendable wire arrow-shaft-holding arms which extend upwardly and forwardly, but preferably slightly behind the launcher to form therewith a three-point arrow shaft cradle which prevents shaft shifting and roll-off from the rest. The resilient arms also act as a side pressure plate or cushion plunger. This is particularly the case when these arms and the launcher are pivotably secured to the cross-arm and spring biased to the upright position by an internal or external cross-arm spring. Fine tuning the bow, as is required with cushion plungers and the like, is obviated with this rest.

The cross-arm may be externally toothed, square in cross-section and incrementally advanceable with click stops, through the block for lateral micro-adjustment. Further features of the invention are set forth in the following detailed description and accompanying drawings.

DRAWINGS

DETAILED DESCRIPTION

Figure 1:
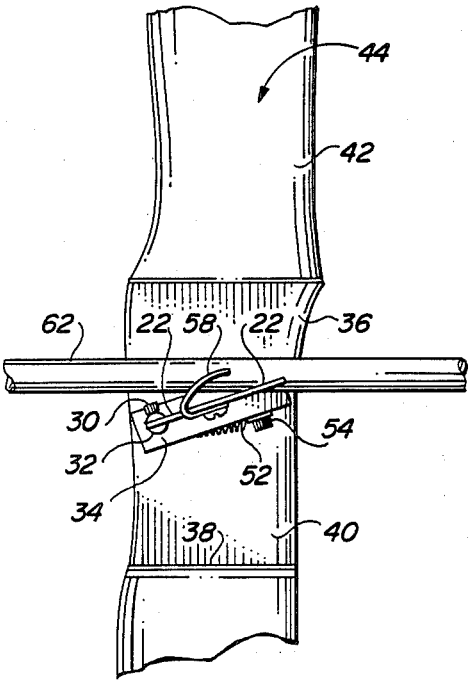
FIG. 1 is a schematic side elevation of a first preferred embodiment of the improved rest device of the present invention shown mounted on an archery bow with an arrow shaft thereon.
Figure 2:
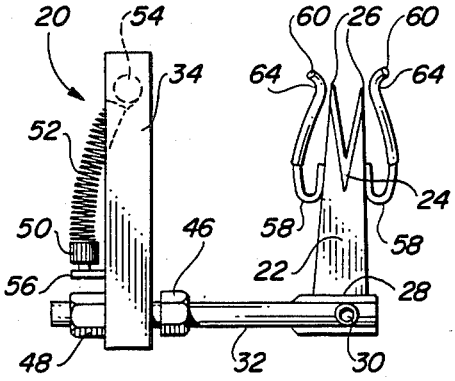
FIG. 2 is an enlarged schematic top plan view of the device of FIG. 1.

FIGS. 1 and 2

Now referring to FIGS. 1 and 2, an arrow rest device 20 is shown therein which comprises a forwardly and upwardly extending thin blade 22 of preferably flexible metal, plastic or the like, with the upper end 24 thereof forked to provide a pair of spaced tines 26 and with the rear end (lower) thereof 28 releasably rigidly secured, as by a screw 30, within a slot (not shown) in a transverse support arm 32.

Arm 32 passes through the rear end of a forwardly extending block 34, shown in FIG. 1 secured to sidewall 36 which defines with shelf 38 a window 40 in the riser secion 42 of an archery bow 44. In this position, block 34 holds blade 22 spaced from sidewall 36 in window 40 and parallel to block 34.

Arm 32 is releasably and adjustably secured to block 34 by nuts 46 and 48, the latter bearing a screw 50 to which a spring 52 is connected, which spring is also connected to a screw 54 at the front underside of block 34. With this arrangement, arm 32 is adjustable transversely relative to block 34 and is rotatable around its longitudinal axis to rotate blade 22 with it between the about upright position shown in FIGS. 1 and 2 and a depressed position caused during shooting of an arrow from rest 20. Spring 52 biases blade 22 into the proper about upright position, which is reached when screw 50 strikes limit pin 56 on the side of block 34.

Device 20 also includes a pair of curved, mantis-like, flexible, resilient, bendable wire arms 58 secured to opposite sides of blade 22 and extending laterally, upwardly therefrom to terminate in flattened ends 60 adapted to contact the sides of an arrow shaft 62 while the underside of shaft 62 rests on tines 26. Arms 58 can be bent to accommodate any size of shaft 62 at the sides thereof either below, or at or above the midline thereof so as to support shaft 62 against any movement including roll-off while it is carried on device 20, as in hunting, with rear end of shaft 62 clipped to the bowstring (not shown). If arms 58 grip shaft 62 above its side mid-line, bow 44 can even be inverted without shaft 62 rolling off rest 20.

Since arms 58 are small, as is blade 22, and depress along with it during shooting, the arrow can be shot without its feathers or vanes striking any part of device 20, shooting accuracy thereby being improved. The side "give" of arms 58 allows a cushion plunger or the like to be obviated and still provide necessary cushioned side resistance to the side bending of shaft 62 during shooting, so that perfect arrow flight results. Arms 58 can be fitted with sleeves or tubes 64 of low frictional resistance plastic or the like for best results. Thus, device 20 is simple, inexpensive, durable and efficient in providing the desired results.

Figure 3:
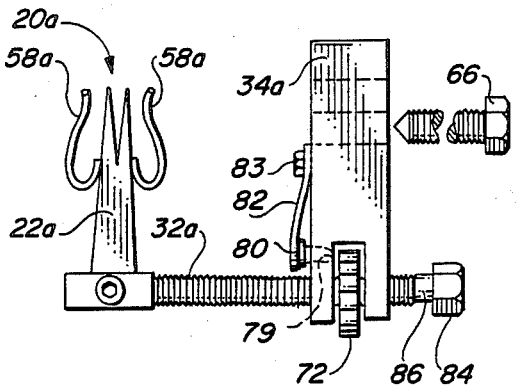
FIG. 3 is a schematic top plan view of a second preferred embodiment of the improved rest device of the present invention.
Figure 4:
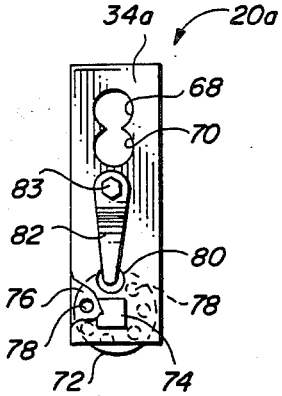
FIG. 4 is a schematic side elevation, partly broken away, of the block and click stop portion of the device of FIG. 3.

FIGS. 3 and 4

A second preferred embodiment of the present rest is schematically shown in FIGS. 3 and 4. Thus, device **20*a* is shown. Components thereof similar to those of FIGS. 1 and 2 bear the same numerals but are succeeded by the letter "a". Device 20*a* is identical to device 20 except that arms 58*a* have no sleeves, blade 22*a* is very resilient since no spring comparable to spring 52 is present, arm 32*a* is square in transverse cross-section, and toothed along its four exterior longitudinal edges, bolt 66 fits either of two contiguous holes 68 and 70 in block 34*a* to secure it to sidewall 36** and an incremental advance and click stop micro-adjustment mechanism is provided.

Thus, block **34*a* has a wheel 72 rotatbly secured therein around opening 74 in block 34*a*. Wheel 72 is grooved or threaded (not shown) so as to engage the external toothed edges of arm 32*a* and thus advance or retard arm 32*a*, depending on the direction of rotation of wheel 72. One face 72 of wheel 72 is provided with circumferentially spaced dimples 78 in which the blunted point 79 of a pin 80 extending into block 34*a* biased by a leaf spring 82 connected to block 34*a* by screw 83 is releasably engaged. As wheel 72 turns, point 79 successively moves out of and drops into one dimple 78 after another, providing a definite feel and an audible click each time it engages a dimple 78. Thus, micro adjustment of the position of arm 32*a* is provided. Stop nut 84 or the like may also be provided on free end 86 of arm 32*a*. Device 20*a* operates similarly to device 20** and has the advantages thereof.

Figure 5:
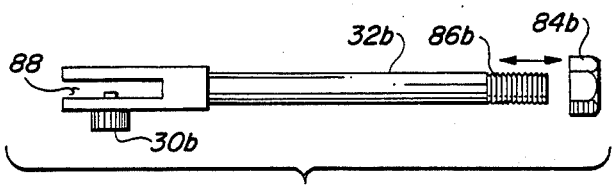
FIG. 5 is a schematic side elevation of a modified version of the transverse arm utilizable in the device of FIG. 1.
Figure 6:
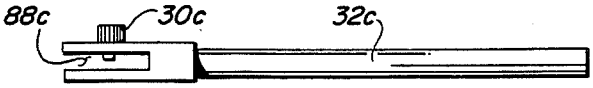
FIG. 6 is a schematic side elevation of another modified version of the transverse arm utilizable in the device of FIG. 1.

FIGS. 5 and 6

FIG. 5 shows a version of the transverse arm utilized in the rest device of the present invention. The arm is designated **32*b* and has a top slot 88, lock screw 30*b* and threaded end 86*b* with lock nut 84*b*. FIG. 6 shows a version of the transverse arm designated 32*c* and having a slot 88*c*, lock screw 30*c* and plain unthreaded shaft. Arms 32*b* and 32*c* can be substituted for arm 32**.

FIG. 7

Figure 7:
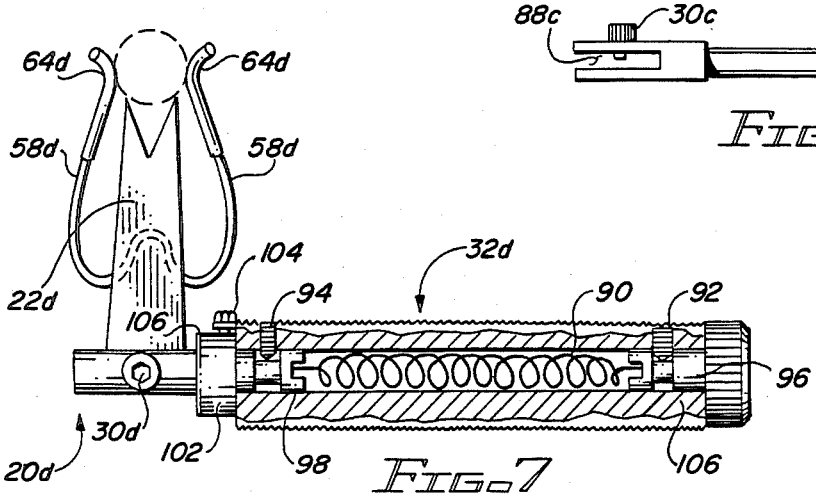
FIG. 7 is a schematic rear perspective view, partly broken away and partly in section, of a third preferred embodiment of the improved rest device of the present invention.

A third preferred embodiment of the present rest device is depicted in FIG. 7. Thus, rest **20*d* is shown, which is substantially identical to rests 20 and 20*a* in structure and function except that arm 32*d* is hollow and bears an internal coiled spring 90 releasably locked, as by pins 92 and 94, in holders 96 and 98, respectively, in arm 32*d*. Holder 96 is fixed in position, in non-rotating portion 100 of arm 32*d*, while holder 98 is connected to rotating portion 102 of arm 32*d* and rotates therewith against the action of spring 90**.

Portion 102 bears blade **22*d* and arms 58*d*, as well as limit screw 104 adapted to strike limit pin 106 on portion 100 to control the proper resting position of blade 22*d* and arms 58*d*. The four exterior edges of portion 100 are toothed, as with arm 32*a* and arm 32*d* may be adapted to be incrementally transversely advanced, in the manner of arm 32*a*. Spring 90 controls the depressibility of blade 22*d* and arms 58*d***.

Figure 8:
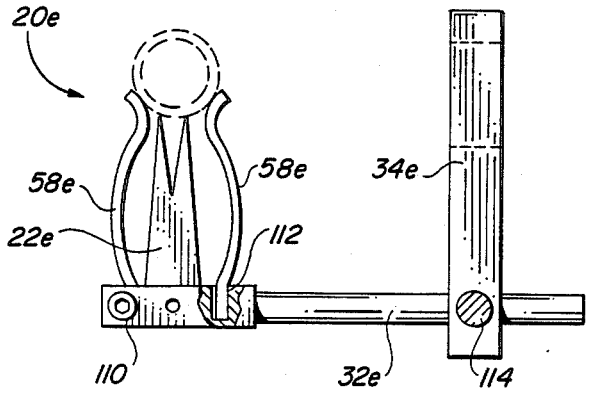
FIG. 8 is a schematic rear perspective view, partly broken away, of a fourth preferred embodiment of the improved rest device of the present invention.
Figure 9:
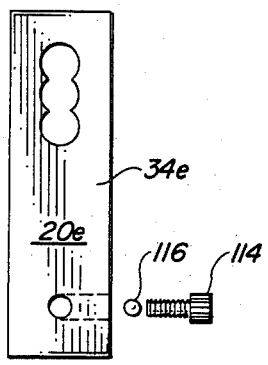
FIG. 9 is a schematic side elevation of the block of FIG. 8.

FIGS. 8 and 9

A fourth preferred embodiment of the improved rest device is depicted in FIGS. 8 and 9. Thus, rest **20*e* is shown which is identical to rest 20 in function and structure, except that arms 58*e* are releasably secured, as by pins 110, in sockets 112 in arm 32*e*. Blade 22*e* is flexible and resilient in the manner of blade 22*a*, and arm 32*e* is releasably locked in block 34*e* by screw 114, with lead ball 116 placed between arm 32*e* and screw 114 in order to protect arm 32*e*** against marring.

FIG. 10

Figure 10:
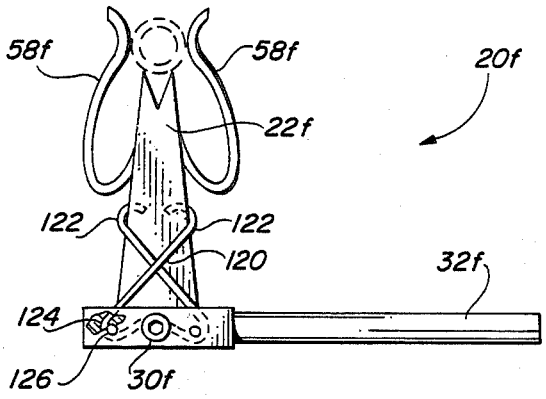
FIG. 10 is a schematic top rear perspective view of a fifth preferred embodiment of the improved rest device of the present invention; and, FIG. 11 is a schematic rear perspective view, partly broken away, of a sixth preferred embodiment of the improved rest device of the present invention.

A fifth preferred embodiment of the improved rest device is depicted in FIG. 10. Thus, rest **20*f* is shown which is identical in function and structure to rest 20 (locking nuts similar to 46 and 48 and a block similar to block 34 not being shown), except that blade 22*f* is pivotably secured to arm 32, rather than fixed in position, by screw 30*f*, blade 22*f* bearing arms 58*f* with it, and except that a return spring 120 is coiled around the base of blade 22*f* with spaced arms 122 of spring 120 gripping opposite sides of blade 22*f* and allowing resilient side movement thereof while base 124 of spring 120 remains locked, as by screws 126, against movement in arm 32*f*. Thus, spring 120 returns blade 22*f* and arms 58*f* to a position perpendicular to arm 32*f*** after their side deflection by an arrow shaft during shooting. Perfect arrow flight is provided by this rest device.

FIG. 11

Figure 11:
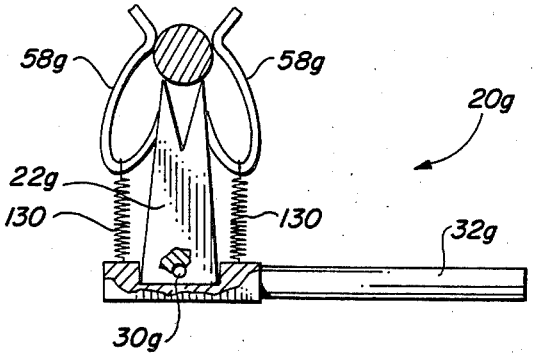

A sixth preferred embodiment of the improved rest device is depicted in FIG. 11 (except for the mounting block thereof). Thus, device 20*g* is shown which is similar to device 20*f* in function and components, differing only in that a pair of spaced parallel coiled springs 130 connected to arms 58*g* on opposite sides of blade 22*g* and to the adjacent surfaces of arm 32*g* substitute for spring 120. Blade 22*g* freely pivots around screw 30*g*, carrying arms 58*g* with it and is returned to the perpendicular aspect shown in FIG. 11 by springs 130. Perfect arrow flight is also provided by this rest device. It is understood that rest devices 20f and 20g can be used in conjunction with the rest device of the FIG. 3 embodiment.

Various other modifications, changes, alterations and additions can be made in the improved rest device of the present invention, its components and their parameters. All such changes, modifications, alterations and additions as are within the scope of the appended claims form part of the present invention.

What is claimed is:

1. An improved archery arrow rest device, said device comprising, in combination:

a. a generally narrow, spring biased resiliently depressible launcher adapted to support only the lower portion of an arrow shaft;

b. a generally transverse launcher support arm receiving the rear end of said launcher, said support arm including a non-rotatable portion and a rotatable portion joined thereto and an internally coiled spring connected to both said portions, said launcher being connected to said rotatable portion for rotation therewith against the bias of said spring;

c. a spaced pair of flexible, resilient, bendable, generally upwardly and forwardly extending arrow-gripping arms secured to at least one of said launcher and said transverse support arm and disposed adjacent to and on opposite sides of said launcher, said arrow-gripping arms extending above said launcher forward end, and adapted to releasably grip opposite sides of an arrow shaft while it is on said launcher so as to prevent inadvertent roll-off of said shaft from said launcher, said arrow-gripping arms obviating the necessity of a plunger, and, d. arrow rest mounting means comprising a generally rearwardly extending mounting block releasably secured to said transverse support arm and adapted to be releasably secured to the sidewall of the riser section of an archery bow defining the window in said bow so as to support said launcher and said arrow-gripping arms in said window spaced laterally from said sidewall.

2. The improved rest device of claim 1 wherein said rotatable and non-rotatable portions bear rotation limit means.

3. An improved archery arrow rest device, said device comprising, in combination:

a. a generally narrow launcher adapted to support only the lower portion of an arrow shaft;

b. a generally transverse launcher support arm receiving the rear end of said launcher;

c. a spaced pair of flexible, resilient, bendable, generally upwardly and forwardly extending arrow-gripping arms secured to at least one of said launcher and said transverse support arm and disposed adjacent to and on opposite sides of said launcher, said arrow-gripping arms extending above said launcher so as to prevent inadvertent roll-off of said shaft from said launcher, said arrow-gripping arms obviating the necessity of a plunger, and, d. arrow rest mounting means comprising a generally rearwardly extending mounting block releasably secured to said transverse support arm and adapted to be releasably secured to the sidewall of the riser section of an archery bow defining the window in said bow so as to support said launcher and said arrow-gripping arms in said window spaced laterally from said sidewall, said transverse support arm extending through and being laterally adjustable and releasably securable to said block to adjustably position said launcher in said window, said transverse support arm being connected to a wheel rotatably secured to said block for incrementally advancing said transverse arm transversely.

4. The improved rest device of claim 3 wherein said transverse support arm is square in transverse cross-section, and is toothed along the four exterior edges thereof and wherein spring biased click stop means are connected to said block and comprise a spring biased against spaced depressions in an annular array on the side of said wheel.

5. The improved rest device of claim 3 wherein said launcher is pivotably secured at the rear end thereof to said transverse support arm and wherein launcher spring means are interconnected to said launcher for resiliently biasing said launcher into a position about perpendicular to said transverse support arm.

6. The improved rest device of claim 5 wherein said arrow-gripping arms are attached to opposite sides of said launcher and extend laterally therefrom.

7. The improved rest device of claim 6 wherein said launcher spring means comprises a pair of spaced springs, each said spring being connected to a different one of said arrow-gripping arms and to the adjacent surface of said transverse support arm.

8. The improved rest device of claim 7 wherein said launcher springs are generally parallel coiled springs.

9. The improved rest device of claim 6 wherein said launcher spring means comprises a spring disposed in a looped path around said launcher and fixedly connected to said transverse support arm.

* * * * *